US006482511B1

(12) United States Patent
Martinez Antonio

(10) Patent No.: US 6,482,511 B1
(45) Date of Patent: Nov. 19, 2002

(54) LASER MARKABLE MONOFILAMENTS

(75) Inventor: Maria Eugenia Martinez Antonio, Sittard (NL)

(73) Assignee: E.I. du Pont de Nemours & Company, Wilmington, DE (US)

( * ) Notice: Subject to any disclaimer, the term of this patent is extended or adjusted under 35 U.S.C. 154(b) by 194 days.

(21) Appl. No.: 09/630,820

(22) Filed: Aug. 2, 2000

Related U.S. Application Data

(60) Provisional application No. 60/147,664, filed on Aug. 6, 1999.

(51) Int. Cl.[7] ..... D02G 3/00; A46B 9/04

(52) U.S. Cl. ..... 428/364; 428/372; 428/373; 428/394; 428/395; 15/159.1; 15/167.1

(58) Field of Search ..... 428/364, 372, 428/375, 394, 395, 373; 15/159.1, 160.1, 167.1

(56) References Cited

U.S. PATENT DOCUMENTS 5,075,195 A * 12/1991 Babler et al. ..... 430/200
5,111,523 A * 5/1992 Ferlier et al. ..... 386/100
5,717,018 A * 2/1998 Magerstedt et al. ..... 524/413
5,760,120 A * 6/1998 Itoh et al. ..... 524/431
5,928,780 A * 7/1999 Schmidt et al. ..... 428/331
6,127,475 A * 10/2000 Vollenberg et al. ..... 524/495

FOREIGN PATENT DOCUMENTS

| | | |
|---|---|---|
| WO | WO 98/03583 | 1/1998 |
| WO | WO 99/66111 | 12/1999 |
| WO | WO 00/01275 | 1/2000 |
| WO | WO 00/05993 | 2/2000 |
| WO | WO 01/11120 A1 * | 2/2001 |

* cited by examiner

*Primary Examiner*—Cynthia H. Kelly
*Assistant Examiner*—J. M. Gray

(57) ABSTRACT

A polymer monofilament, which includes up to five percent by weight of at least one radiation-sensitive, mark-forming additive, said weight percentage based on the total weight of the polymer and additive only, is marked with a laser. The laser-marked monofilament may be used as a bristle for a brush such as a toothbrush or a paint brush.

11 Claims, No Drawings

LASER MARKABLE MONOFILAMENTS

This application claims the benefit of U.S. Provisional Application No. 60/147,664, filed Aug. 6, 1999.

FIELD OF THE INVENTION

This invention relates to laser-markable monofilaments which may be used, for example, in a toothbrush or a paint brush.

BACKGROUND OF THE INVENTION

The labeling of products manufactured from polymers is very important in today's marketplace. Printing, embossing and stamping are techniques conventionally used to add text, symbols and design elements to the surface of polymer products. Laser marking is also becoming a widely used technique. This process produces a permanent mark that can not be removed from a product without damage. A good quality laser mark cannot be achieved with all polymers or products, however. A need remains for the design of products on which laser marking may be successfully used, and for the design of methods to make such products.

SUMMARY OF THE INVENTION

As a means of addressing such need, one aspect of this invention involves a laser markable and laser marked polymer monofilament.

In another aspect, this invention involves a method of marking a monofilament by (a) preparing a monofilament from a composition containing a polymer and up to five percent by weight of a radiation-sensitive, mark-forming additive in the form of an organic pigment, inorganic pigment, polymer-soluble dye, or mixtures thereof, said weight percentage based on the total weight in the composition of polymer and radiation-sensitive, mark-forming additive only; and (b) inscribing a mark on the monofilament by irradiation with a laser.

In a further aspect, this invention involves a method of making a brush by (a) providing a plurality of bristles made from monofilament prepared from a composition containing a polymer and up to five percent by weight of a radiation-sensitive, mark-forming additive in the form of an organic pigment, inorganic pigment, polymer-soluble dye, or mixtures thereof, said weight percentage based on the total weight in the composition of polymer and radiation-sensitive, mark-forming additive only; (b) affixing the bristles to the brush; and (c) inscribing a mark on one or more bristles by irradiation with a laser.

DETAILED DESCRIPTION OF THE INVENTION

The products and methods of this invention address the fact that polymers with a low absorption level of laser light show practically no reaction when subjected to laser light; the laser beam passes through the plastic without creating a visible mark. As a result, a laser-sensitive pigment is added to a polymer to make it more receptive to laser light, that is, markable by laser light. The addition of the pigments permits intensive dark and light marking in the polymers under laser treatment. The color of the marking will depend on the type of polymer, the pigment and the laser. The result is a high contrast, visible mark of the pigment on the polymer after being treated with a laser.

A particularly preferred use of laser marking in this invention relates to marking a monofilament prepared from a composition that contains a polymer and up to five percent by weight of at least one radiation-sensitive, mark-forming additive in the form of an organic pigment, an inorganic pigment, a polymer-soluble dye, or mixtures thereof, said weight percentage being based on the total weight of the polymer and additive only. The monofilament may be used as a bristle for a brush such as a toothbrush or a paint brush.

A variety of polymers may be used in the composition from which the monofilament is prepared, including for example nylon, polyester, polyethylene, polypropylene, polystyrene and/or polycarbonate. Nylon and polyester are preferred. Examples of suitable nylon (polyamide) polymers include nylon 6; nylon 6,6; nylon 6,10; nylon 6,12; nylon 6,9; nylon 10,10, nylon 11, nylon 12, copolymers thereof or mixtures thereof. Examples of suitable polyesters include polyethylene terephthalate, polybutylene terephthalate, polytrimethylene terephthalate, copolymers thereof, or mixtures thereof.

The radiation-sensitive, mark-forming additive may be any additive that forms a bright and irreversible marking when subjected to a laser light having a wavelength in the UV, visible, or infrared part of the spectrum, thus the term "mark-forming". The additive may, for example, be an organic pigment, an inorganic pigment, a polymer-soluble dye, or mixtures thereof. Illustrative examples of such additive include a flat mica platelet coated with one or more thin metal oxide layers, such as iron oxide, tin oxide and/or titanium dioxide; carbon black; graphite; copper (II) hydroxide phosphate; molybdenum (VI) oxide; and pigments based on mica/$TiO_2$, such as Iriodin® LS pigments available from Merck KgaA, Darmstadt, Germany. Optionally, the composition from which monofilament is prepared may also include other supplemental dyes or pigments in addition to the radiation-sensitive, mark-forming additive. These other dyes or pigments form a contrasting background so that when the monofilament is laser marked, the mark is more distinct and easier to see on the monofilament than if such supplemental dyes or pigments were not present in the composition.

The radiation-sensitive, mark-forming additive should be present in an amount such that a readable laser mark is formed on the monofilament. The radiation-sensitive mark-forming additive is preferably present in an amount of up to about 5 weight percent, based on the total weight in the composition of polymer and additive only. A more preferred range for use of the additive is from 0.1 to 2 weight percent, also based on the total weight in the composition of polymer and additive only. Use of the additive in amounts greater than 5 weight percent is possible but should take into account the effect of the additive on coloration in areas of the monofilament other than the location of the mark, as well as the effect of the mark-forming additive in combination with other additives, such as fillers, on the material properties or performance characteristics of the monofilament.

In addition to the components discussed above, the composition from which a monofilament of this invention is made may contain commonly-employed additives such as antibacterial agents, foaming agents, fillers such as clay and talc, optical brighteners, lubricants or dispersion aids such as fatty acid esters or acrawax c, antioxidants, heat stabilizers, UV stabilizers, and the like.

The invention also relates to a process for preparing a laser-markable monofilament by (i) providing granules of a masterbatch that contains polymer and a high concentration of a radiation-sensitive, mark-forming additive in the form of an organic pigment, inorganic pigment, polymer-soluble dye, or mixtures thereof, (ii) providing granules of the polymer itself, (iii) optionally, providing granules containing polymer and a low concentration of radiation-sensitive additive, and (iv) extruding the various granules together into a monofilament, wherein the amount of radiation-sensitive mark-forming additive in the masterbatch is such that the amount of radiation sensitive mark-forming additive in the final monofilament composition is up to about 5 weight percent, said weight percentage based on the total weight in the composition of polymer and radiation-sensitive mark-forming additive only.

The type of laser to be used may depend on whether the radiation-sensitive, mark-forming additive to be used is sensitive to laser radiation at only certain wavelengths. If so, a laser is selected that is operable at the wavelength needed for the sensitivity of a particular selected additive. Some additives, however, can be used with all laser types. Examples of useful lasers are a $CO_2$ laser, or a Nd:YAG laser (Neodymium:Yttrium Aluminum Garnet, the garnet crystal being composed of the elements yttrium, aluminum and oxygen). With a Nd:YAG laser the preferred wavelength is 532 or 1064 nm. Nd:YAG lasers operable at both the 532 and 1064 nm wavelengths are available from Haas Laser and Laser Plus. The Haas instrument is characterized by a power of 16–65 watts, and a markingfield of 110×110 or 120×120 mm; and the Laser Plus instrument by a power of 20–60 watts, and a markingfield of 115×115 mm.

A monofilament is prepared by conventional processing such as stretching, annealing, winding and conditioning (drying). Laser marks may be formed on a monofilament before it is further fabricated to prepare it for further use by irradiating the monofilament with a laser having a wave length in the UV, visible, or infrared region of the spectrum. More typically, however, using conventional cutting, tufting and affixing methods, the laser markable monofilaments are cut into pieces suitable for use as bristle in a brush such as a toothbrush or a paintbrush; made into tufts if necessary; affixed to the brush; and then laser marked by irradiating the monofilaments with a laser having a wave length in the UV, visible, or infrared region of the spectrum.

As used herein, the term "monofilament" includes a filament that is coextruded so as to have a core of a first polymer, and a sheath of a composition containing a second polymer and up to 5 weight percent of a radiation-sensitive, mark-forming additive. The term "core" refers to the central portion of the coextruded filament, as examined in cross section, and the term "sheath" refers to an outer coating layer or layers over the core material of the coextruded filament. It is preferred that the sheath be relatively thin, having a thickness of from about 5 to about 50 $\mu$m. The first and second polymers may each be any of the polymers listed above, or may also be the same polymer. Use of a sheath/core monofilament in a toothbrush is especially desirable when the sheath layer contains a laser marking because the sheath layer, including the laser marking, will wear off easily as the toothbrush is used, and serve as a wear indicator to remind the customer to replace the toothbrush.

The monofilaments of this invention may be marked with a laser to display letters to form words, including names such as brand names or customer names; to form a corporate logo; or to form designs or patterns.

EXAMPLES 1–8

In the following examples, monofilaments are prepared and laser marked according to the following procedure. A first master batch (MB1) is prepared by blending an Iriodin® pigment from Merck with nylon 6,12 to form granules having 30 weight percent of the pigment and 70 weight percent of the nylon 6,12. A separate form of MB1 is prepared for each of the Iriodin® pigments, LS825 and LS830. Iriodin® LS825 pigment is used to get a bronze mark on white and yellow colored monofilaments, and Iriodin® LS830 pigment is used to get a white/gray mark on black or dark-colored monofilaments.

A second master batch (MB2) is prepared by blending a selected amount of supplemental colored pigment, as shown below in Table 1, with nylon 6,12. A separate form of MB2 is prepared for each of the different loadings and colors of the supplemental pigments. A composition is prepared by blending five weight percent of MB1 granules, a selected amount of MB2 granules (as shown in Table 1) and sufficient nylon 6,12 to form a composition containing 1.5 wt % of the Iriodin® pigment based on the total weight in the composition of nylon 6,12 and Iriodin® pigment only. A separate composition is prepared for each of eight different combinations of the various forms of MB1 and MB2, and a monofilament is extruded from each of the compositions.

The monofilament of each of the eight compositions is exposed to a VectorMark® Compact Nd:YAG laser (Haas-Laser GmbH+Co., Schramberg, Germany) at wavelengths of 532 and 1064 nm (IR). The Nd:YAG laser is operated in the beam deflection method wherein a set of computer-controlled mirrors is used to steer the laser beam in x-y directions, followed by a lens to focus it on the surface. The exposure time of the monofilaments to the laser is set forth in Table 1 in seconds.

TABLE 1

| Ex. No. | Monofilament composition in wt % of MB1/MB2/nylon 6,12 | Color and wt % of pigments in MB2 | LS pigment in MB1 | Wave-length of laser, nm | Exposure time to laser, s |
|---|---|---|---|---|---|
| 1 | 5/2/93 | White/0.15 | LS825 | 532 | 7.0 |
| 2 | 5/2/93 | White/0.15 | LS825 | 1064 | 2.5 |
| 3 | 5/2.2/92.8 | Yellow/0.19 | LS825 | 532 | 9.0 |
| 4 | 5/2.2/92.8 | Yellow/0.19 | LS825 | 1064 | 2.5 |
| 5 | 5/2/93 | Red/0.25 | LS830 | 532 | 6.0 |
| 6 | 5/2/93 | Red/0.25 | LS830 | 1064 | 2.5 |
| 7 | 5/1.9/93.1 | Blue/0.32 | LS830 | 532 | 9.0 |
| 8 | 5/1.9/93.1 | Blue/0.32 | LS830 | 1064 | 2.6 |

The result of each of Examples 1–8 was a monofilament having a laser mark in the form of a word in which the intensity of the mark is the same in all of the letters.

What is claimed is:

1. A laser marked polymer monofilament.

2. A monofilament according to claim 1 wherein the monofilament is prepared from a composition comprising up to five percent by weight of a radiation-sensitive, mark-forming additive in the form of an organic pigment, inorganic pigment, polymer-soluble dye, or mixtures thereof, said weight percentage based on the total weight in the composition of polymer and radiation-sensitive, mark-forming additive only.

3. A monofilament according to claim 1 wherein the polymer is nylon or polyester.

4. A monofilament according to claim 1 wherein the radiation-sensitive, mark-forming additive comprises a flat mica platelet coated with one or more thin metal oxide layers.

5. A monofilament according to claim 1 wherein the polymer comprises nylon and the radiation-sensitive, mark-forming additive comprises mica and titanium dioxide.

6. A monofilament according to claim 1 wherein the monofilament comprises a core of a first polymer and a sheath of a second polymer.

7. A monofilament according to claim 1 wherein the laser mark is a word.

8. A monofilament according to claim 1 wherein the laser mark is a corporate logo.

9. A monofilament according to claim 1 wherein the laser mark is a design.

10. A monofilament according to claim 1 in the form of a brush bristle.

11. A brush comprising a bristle according to claim 10.

* * * * *